US005904315A

United States Patent [19]

McInerney

[11] Patent Number: 5,904,315

[45] Date of Patent: May 18, 1999

[54] EXPANSION SLEEVE

[75] Inventor: John K. McInerney, New Kensington, Pa.

[73] Assignee: Allegheny Ludlum Corporation, Pittsburgh, Pa.

[21] Appl. No.: 08/554,647

[22] Filed: Nov. 9, 1995

[51] Int. Cl.[6] ..... B65H 75/24

[52] U.S. Cl. ..... 242/571; 242/573.9

[58] Field of Search ..... 242/571, 571.1, 242/571.2, 571.6, 571.7, 572–575.5, 597.5, 597.6; 279/2.21, 2.24; 269/48.1

[56] References Cited

U.S. PATENT DOCUMENTS

| | | | |
|---|---|---|---|
| 2,656,990 | 10/1953 | Radtke | 242/571.6 |
| 3,106,362 | 10/1963 | Sukala | 242/571 |
| 3,206,135 | 9/1965 | Uncapher | 242/573.2 |
| 3,552,673 | 1/1971 | Evers | 242/573.2 |
| 3,917,187 | 11/1975 | Damour | 242/571.1 |
| 3,963,250 | 6/1976 | Flagg | 242/571.7 |
| 4,254,918 | 3/1981 | Huggins | 242/573 |
| 4,802,637 | 2/1989 | Williams | 242/597.5 |
| 4,832,276 | 5/1989 | Gebhardt et al. | 242/573.7 |
| 4,893,765 | 1/1990 | Randolph | 242/571.6 |

*Primary Examiner*—John M. Jillions
*Attorney, Agent, or Firm*—Patrick J. Viccaro

[57] ABSTRACT

Apparatus for increasing the diameter of an expansible reel. The apparatus includes an expansible sleeve member to be disposed over the reel and one or more elastic expansible members to maintain the sleeve member in contact with the reel, but which allow the reel to fully expand.

12 Claims, 4 Drawing Sheets

EXPANSION SLEEVE

BACKGROUND OF THE INVENTION

1. Field of the Invention

The present invention relates to an apparatus for increasing the effective diameter of an expansible reel. The present invention more particularly relates to an apparatus for increasing the effective diameter of an expansible payoff reel so that metal coils of varying internal diameters may be retained securely on the reel during payoff of the coiled metal.

2. Description of the Invention Background

During manufacture and treatment, steel strip may be coiled on reels of varying diameters to provide steel coils with varying inside diameters. The coiled steel strip subsequently may be subjected to various finishing treatments and processes and the coils must be unwound into processing equipment from a payoff reel. To securely hold the steel coil during payoff into the processing equipment, the payoff reel typically is capable of expanding to increase its outer diameter. The coil initially is disposed on the payoff reel while the reel is in an unexpended state and has a relatively small outer diameter. The reel's unexpended state is referred to herein as its "collapsed" configuration. The reel is then mechanically expanded to assume what is referred to herein as an "engaged" configuration in which the diameter of the reel is enlarged to securely grip the coil's inside diameter.

Because coils may have different inside diameters, payoff reels often must be equipped with some means to increase the effective diameter of the payoff reel so that it will securely grip the coil's inside diameter as the payoff reel expands. One method for increasing payoff reel diameter is to insert lengths of 2"×4" or 4"×4" wood between the coil's inside diameter and the payoff reel before expanding the reel. This method is unsatisfactory because the coils may slip on the payoff reel and any wood splinters may damage the internal mechanism of the reel.

An alternative method to increase the outside diameter of an expansible payoff reel is to removably attach a series of buildup plates, typically composed of steel or nylon, to outer surfaces of those segments of the payoff reel that contact the coil's inner diameter. Each steel buildup plate may weigh in excess of 100 pounds and is difficult to handle and install. Installation of steel buildup plates normally may require 30–45 minutes and removal another 30–45 minutes, during which time the processing equipment will be unavailable for use. To facilitate installation of buildup plates, the plates may first be attached to the inner diameter of two steel rings in the orientation in which the plates would be when connected to the payoff reel. The assembly of plates connected to the rings is then disposed over the payoff reel, the buildup plates are bolted in position onto the reel and then the steel rings are removed from the buildup plates. Positioning the assembly of plates and rings over the reel is difficult and a coil buggy must be used because the assembly is quite heavy. Also, no net time savings is achieved using the steel rings because additional operations are required to remove the rings from the buildup plates during their installation on the reel and to replace the steel rings over the buildup plates before removing the plates from the reel.

Accordingly, a need exists for an improved apparatus to increase the diameter of an expansible payoff reel. The improved design must allow the reel to completely expand and securely grip the inside diameter of a coil. The improved design should also be quickly installed and removed, and should remain in place on the payoff reel when the coil has completely payed off of the reel.

SUMMARY OF THE INVENTION

To satisfy the above needs, the present invention provides an expansion sleeve for increasing the diameter of a payoff reel that may be expanded from a small diameter collapsed configuration to a larger diameter engaged configuration. The present invention's expansion sleeve includes a sleeve member that may expand reversibly between a contracted configuration and an expanded configuration. The sleeve member includes a void into which a payoff reel may be inserted.

In a preferred configuration, the present expansion sleeve is composed of a wall that defines a generally cylindrical shape having a first and second end, an external outer surface for contacting the coil and an internal surface defining the void. To allow the wall to expand reversibly, a continuous slit is provided through the wall between the first and second ends. To prevent the tail of a coil from grabbing the slit as the coil is payed off, the slit may be of a sawtooth design.

The present invention's expansion sleeve also includes one or more expansible members that urge the sleeve member into its contracted configuration, but which allow the sleeve member to reversibly expand as the payoff reel expands between its collapsed and engaged configurations. The one or more expansible members may be continuous bands of an elastic material such as polyurethane or a rubber material disposed around the outer surface of the sleeve member and across the slit. The one or more expansible members have elastic properties sufficient to urge the sleeve member to assume its contracted configuration as the payoff reel contracts to its collapsed configuration.

To protect the one or more expansible members from being damaged when the coil is disposed on the sleeve member, the outer surface of the sleeve member may include a groove for each expansible member. The grooves may have a depth greater than the thickness of the expansible members so that the expansible member will not protrude above the surface of the sleeve member to prevent the expansible members from contacting the coil.

The present expansion sleeve further may include a coil guide that protects the sleeve member from being damaged when the coil is introduced onto the expansion sleeve. The coil guide may be comprised of a durable material and may be disposed on the sleeve member. To allow the coil guide to be attached to the sleeve member, the coil guide may have a mating surface that is configured to conform to part of the outer surface of one or both of the first and second ends of the wall of the sleeve member.

To further protect the ends of the sleeve member from being damaged by the coil, it is preferred that the outer surface of one or both of the sleeve member wall's first and second ends include a tapered guide region. The guide region may consist of a chamfered region located at the terminus of one or both of the first and second ends and an adjacent non-chamfered region. So that a coil guide may be attached onto the guide region, the mating surface of the coil guide may be configured to conform to at least a portion of the chamfered and non-chamfered regions of the guide region.

The coil guide preferably consists of a plurality of guide plates, each guide plate including a mating surface configured to conform to a portion of the guide region. The individual guide plates preferably are disposed at intervals about the circumference of the guide region. The guide plates will take the brunt of the force if the leading edge of the coil or the coil's gripper kink contacts the expansion sleeve as the coil is advanced onto the sleeve member. As an alternative, the coil guide may be a substantially circular cowling having a mating surface configured to conform to a portion of the entire circumference of the guide region. The mating surface of the cowling is positioned on the guide region so that the circular bore allows the payoff reel access to the void of the sleeve member. To allow the cowling to expand and contract as the sleeve member expands and contracts, the cowling includes a gap that preferably is positioned generally over the slit in the sleeve member and generally matches the path of the slit.

The expansible sleeve of the present invention may be disposed on a payoff reel quickly and easily, typically within 2 to 5 minutes and, therefore, reduces installation time and removal time by up to 90% or more relative to buildup plates. The expansible sleeve is biased into its contracted configuration by the one or more expansible members and, in this configuration, is sized so that it may be inserted over an expansible payoff reel when the reel is in a collapsed configuration. The expansible sleeve of the present invention expands as the payoff reel expands, and the one or more expansible members retain the sleeve member on the reel as the sleeve expands to engage the inner diameter of a coil. The expansible members also serve to contract the sleeve member and retain the sleeve member on the payoff reel when the reel is contracted back to its collapsed configuration.

In practice, it is contemplated that a number of expansion sleeves constructed as described herein may be provided having different internal and/or external diameters so that an operator may select between the various expansion sleeves to adapt an expansible payoff reel to securely engage coils having various inner diameters. An expansion sleeve that is attached on the payoff reel may be easily and quickly replaced with an expansion sleeve of a different outer diameter so that the reel may accept the particular coil to be processed.

These and other advantages will be apparent from the following detailed description of an embodiment of the invention.

DETAILED DESCRIPTION OF THE PREFERRED EMBODIMENT

Figure 1:
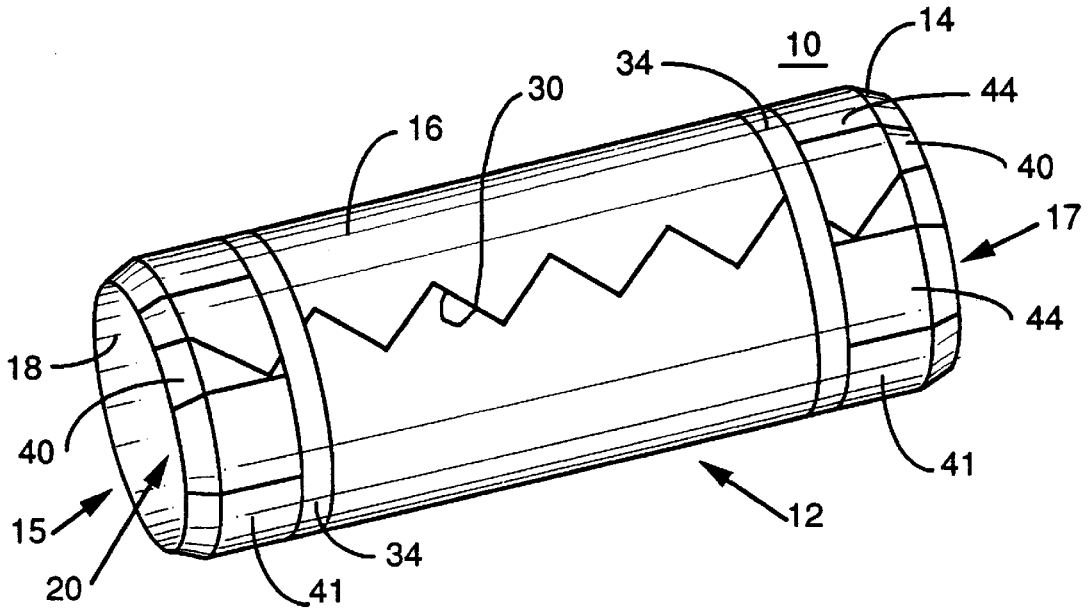
FIG. 1 is a perspective view of a preferred embodiment of the expansion sleeve of the present invention.
Figure 2:
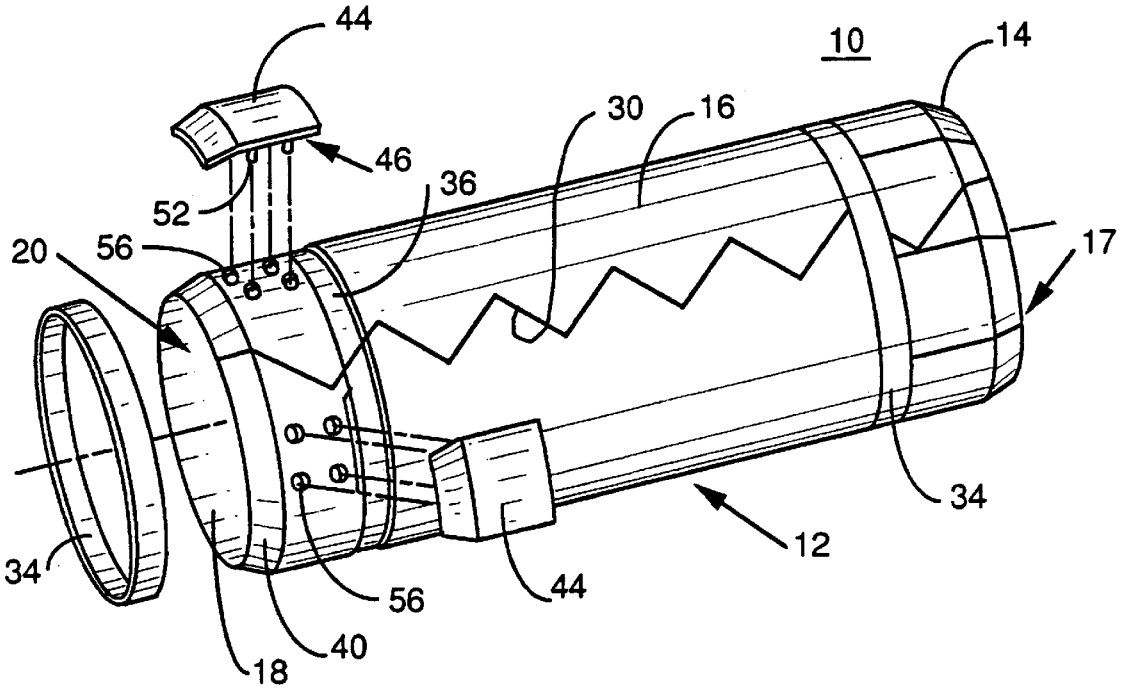
FIG. 2 is a partial assembly view in perspective of the expansion sleeve of FIG. 1.

Referring now to the drawings, which are for the purpose of illustrating the preferred embodiment of the present invention and not for the purpose of limiting the same, FIGS. 1 and 2 depict the preferred design of the expansion sleeve 10 of the present invention. The expansible sleeve 10 includes a sleeve member 12 preferably constructed of a wall 14 having a first end 15, an opposed second end 17, an outer surface 16 and an inner surface 18. The inner surface 18 surrounds an internal void 20 that extends entirely through the sleeve member 12 between the first end 15 and the second end 17.

Figure 6:
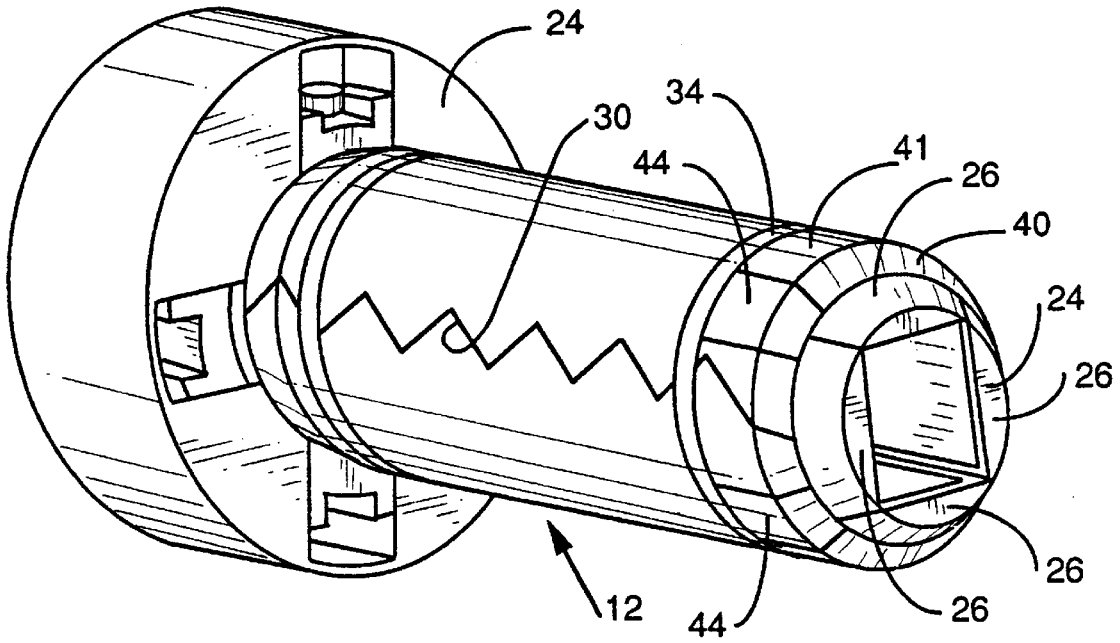
FIG. 6 is a perspective view of the expansion sleeve of FIG. 1 installed on an expansible payoff reel and wherein the expansion sleeve is in a contracted configuration.
Figure 7:
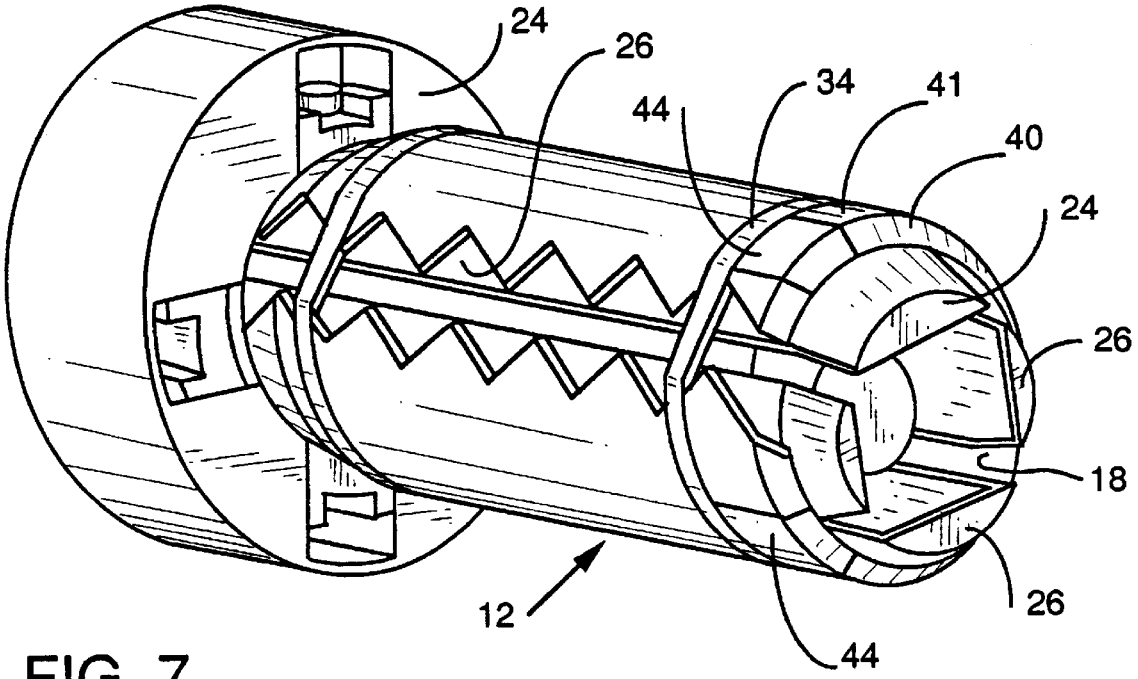
FIG. 7 is a perspective view of the expansion sleeve of FIG. 1 shown installed on a payoff reel and wherein the expansion sleeve is in an expanded configuration.

As shown in FIG. 6, the sleeve member 12 may be disposed over an expansible payoff reel 24 so that the payoff reel 24 is disposed through the first end 15, through the void 20, and extends out from the second end 17. The void 20 of sleeve member 12 is of a size and shape so that the sleeve member may be disposed over the payoff reel 24 when the payoff reel is in its collapsed configuration and so that the payoff reel 24 impinges on the inner surface 18 and forces wall 14 outward when the payoff reel 24 is expanded to its engaged configuration shown in FIG. 7. The expansible payoff reel 24 depicted in FIGS. 6 and 7, not a part of the present invention, is of a conventional design and includes four moveable elements 26 that may be caused to move outward from the payoff reel's longitudinal axis to increase the payoff reel's diameter from a collapsed configuration (FIG. 6) to an engaged configuration (FIG. 7). Although the expansion sleeve 10 of the present invention is depicted and described in relation to an expansible payoff reel 24 of a particular design, it is understood that the expansion sleeve 10 of the present invention may be used with any reel member having a selectively adjustable diameter.

When the expansion sleeve 10 is disposed over the payoff reel 24, a coil (not shown) may be disposed over the sleeve member 12 so that the coil's inner diameter opposes the outer surface 16 of the sleeve member 12. The sleeve member's wall 14 preferably is generally cylindrical so that the outer surface 16 and the void 20 also are generally cylindrical. The void 20 is preferably cylindrical to maximize contact between inner surface 18 and the payoff reel 24, and the outer surface 16 is generally cylindrical to maximize its contact with the coil's inner diameter. However, it will be understood that the wall 14 may assume any shape such that the outer surface 16 and the void 20 will sufficiently secure the coil to the payoff reel 24 when the payoff reel 24 is expanded to its engaged configuration.

The length of the sleeve member 12 between first end 15 and second end 17 is selected according to the width of the coil's inside diameter and the length of the payoff reel 24 on which the sleeve member 12 is to be installed. The inner diameter of the sleeve member 12 (i.e., the diameter of void 20) is determined by the diameter of the payoff reel 24 on which the sleeve member 12 is to be installed, and the outer diameter of the sleeve member 12 is selected according to the inner diameter of the coiled material to be disposed over the sleeve member 12.

It is preferred that the sleeve member 12 is composed of a material that will grip both the inner diameter of the coil and the payoff reel 24 when the payoff reel 24 is in its engaged configuration and so that neither the coil nor the sleeve member 12 will slip significantly during payoff of the coiled strip. It also is preferred that the sleeve member 12 is composed of a material that will withstand abrasion from the coil and, if present, the coil's gripper kink when the coil is installed over the sleeve member 12 and during payoff. Also, the sleeve member preferably is of a material that is lightweight and easy to handle and position on payoff reel 24. To those ends, it is preferred that the sleeve member is produced from a polymer material, preferably a polyurethane, having a hardness of at least 90 durometer and, more preferably, at least 95 durometer. As provided herein, durometer hardness measurements are determined using a Durometer Gauge (A scale), available from Wilson Shore, Garden City, N.J.

So that the sleeve member 12 may reversibly expand as the payoff reel 24 expands from its collapsed to its engaged configuration, the sleeve member 12 includes a slit 30 through wall 14 and continuous from the first end 15 to the second end 17. By increasing the width of slit 30, the sleeve member 12 may expand from a contracted configuration, wherein the width of slit 30 is small and the sleeve member's outer diameter is at a minimum, to an expanded configuration, wherein the width of slit 30 is increased and the sleeve member's outer diameter is increased. The mode by which the sleeve member 12 expands is illustrated by comparing FIG. 6, wherein the sleeve member 12 is in its contracted configuration and is disposed over payoff reel 24 in its collapsed configuration, and FIG. 7, wherein the payoff reel 24 is expanded to its engaged configuration and sleeve member 12 correspondingly expands to an expanded configuration by increasing the width of slit 30.

Slit 30 may follow any continuous path between the first end 15 and the second end 17. As shown in FIGS. 1, 2 and 5–7, it is preferred that slit 30 follows in a generally overlapping sawtooth path between the first and second ends (15, 17) and is disposed generally along a longitudinal axis of the sleeve member 12. The slit's sawtooth design inhibits the coil's gripper kink from grabbing the slit 30 and damaging the expansion sleeve 10 (and the expansible members 34 described below) as the coiled sheet pays off from the coil. The likelihood that the expansion sleeve 10 will be damaged in this way is much greater when the slit 30 is disposed in a straight path along a longitudinal axis of the sleeve member 12.

The expansion sleeve of the present invention also includes at least one expansible member for urging the sleeve member 12 into its contracted configuration. As best shown in FIG. 2, the expansible member preferably is in the form of two elastic continuous bands 34. The bands 34 bias the sleeve member 12 into its contracted configuration when the payoff reel 24 is contracted to its collapsed configuration. The bands 34 also bias together the regions of the sleeve member 12 that are separated by slit 30 so that the sleeve member 12 does not fall open under its own weight at slit 30. If the sleeve member 12 does fall open at slit 30 it may become difficult to handle and also may fall off of the payoff reel 24. The bands 34 preferably are disposed about the outer surface 16 of the sleeve member 12 and across slit 30. The bands 34 preferably have a diameter when arranged in a circle that is slightly smaller than the outer diameter of the sleeve member 12 so that when the bands 34 are disposed about the outer surface 16 of the sleeve member 12, the bands 34 are slightly stretched and exert force on the sleeve member 12 to urge slit 30 to a minimum width and to thereby urge sleeve member 12 to its contracted configuration. As the sleeve member 12 is expanded by the payoff reel 24, the bands 34 also expand and exert force to minimize the width of slit 30 and thereby urge the inner surface 18 of the sleeve member 24 to contact the payoff reel 24.

To provide the above elastic characteristics, bands 34 preferably are of an elastic rubber with hardness of about 70 durometer. However, it will be understood that the bands 34 may be of any material, for example, polyurethane, that will provide the desired elastic properties. Also, although the expansible members of the present invention are described in connection with the preferred embodiment as being two continuous elastic bands 34, it will be understood that fewer or more than two bands 34 may be used. It will also be understood that the expansible members need not be in the form of continuous bands 34 and may assume any configuration and be composed of any material with an elastic modulus that will urge slit 30 toward a minimum width with sufficient force.

The expansion sleeve 10 of the present invention may be quickly and easily installed on a payoff reel 24. The expansion sleeve first may be rolled by hand or machine onto a coil buggy. The expansion sleeve 10 then is positioned with the first or second end (15, 17) adjacent the free end 25 of the payoff reel 24 and is slid onto the reel 24. FIG. 6 shows the expansion sleeve 10 in its contracted configuration on a collapsed payoff reel 24. Installation and removal typically each take between two and five minutes and neither require any heavy exertion by an individual.

Once the expansion sleeve 10 has been installed on the payoff reel 24, a coil may be positioned on the expansion sleeve 10 in the conventional manner. The payoff reel 24 is then expanded to its engaged configuration and, as shown in FIG. 7, the expansion sleeve 10 also expands by increasing the width of slit 30.

To protect the bands 34 from damage by the coil, outer surface 16 of the sleeve member 12 preferably includes two continuous grooves 36 having a depth larger than the thickness of bands 34. Each band 34 is disposed in one of the grooves 36. Because the depth of each groove 36 is greater than the thickness of the bands 34, each band 34 is disposed in a groove in a countersunk condition wherein the band 34 is below the outer surface 16 of the sleeve member 12 adjacent the groove 36. Countersinking the bands 34 in this way prevents the coil from contacting the bands 34 when the coil is installed on the expansion sleeve 10 and during payoff. Countersinking bands 34 also maintains the bands 34 in a desired location on the sleeve member 12 and allows for the easy expansion and quick contraction of the sleeve member 12 to facilitate coil loading. It will be understood that the configuration and positioning of grooves 34 will depend on the configuration and desired positioning of the one or more expansion members of the expansible sleeve 10.

To further facilitate coil loading onto the expansion sleeve 10, each of the first and second ends (15, 17) of the sleeve member 12 preferably may be tapered as shown in, for example, FIGS. 1 and 2. In the preferred embodiment of expansion sleeve 10, a terminal portion of the first and second ends (15, 17) are chamfered at 45° to provide a chamfered region 40. As further illustrated in FIGS. 1 and 2, a non-chamfered region 41 preferably is disposed between the chamfered region 40 and the grooves 36. If the leading edge of a coil contacts the chamfered region during coil loading, the coil will not be prevented from sliding further onto the expansion sleeve 10. Although in the present preferred embodiment both the first and second ends (15, 17) are tapered, it will be understood that the sleeve member 12 may have only one with a chamfered region 40 with like effect as long as the expansion sleeve 10 is disposed on the payoff reel 24 so that the chamfered region 40 is adjacent the free end of the payoff reel 24.

To protect one or both of the first and second ends (15, 17) of the sleeve member 12, the expansion sleeve 10 may include one or more coil guides having at least one surface of a durable material and positioned on the sleeve member 12 so as to protect the ends (15, 17) when a coil is introduced onto the sleeve member 12. As shown in FIGS. 1, 2, 6 and 7, in the preferred embodiment of the expansion sleeve 10 the coil guides are in the form of steel guide plates 44 that have a mating surface 46 configured to conform to the contour of a portion of the chamfered region 40 and a portion of the adjacent non-chamfered region 41 of the sleeve member 12. As shown in FIGS. 1, 2, 6 and 7, it is preferred that each guide plate 44 cover only a discrete portion of the circumference of an end (15, 17) and that a plurality of guide plates 44 are positioned at intervals around the circumference of an end (15, 17) with unprotected regions between each of the guide plates 44. The slit 30 is located in one of the unprotected regions so that the sleeve member 12 may expand freely.

Figure 3:
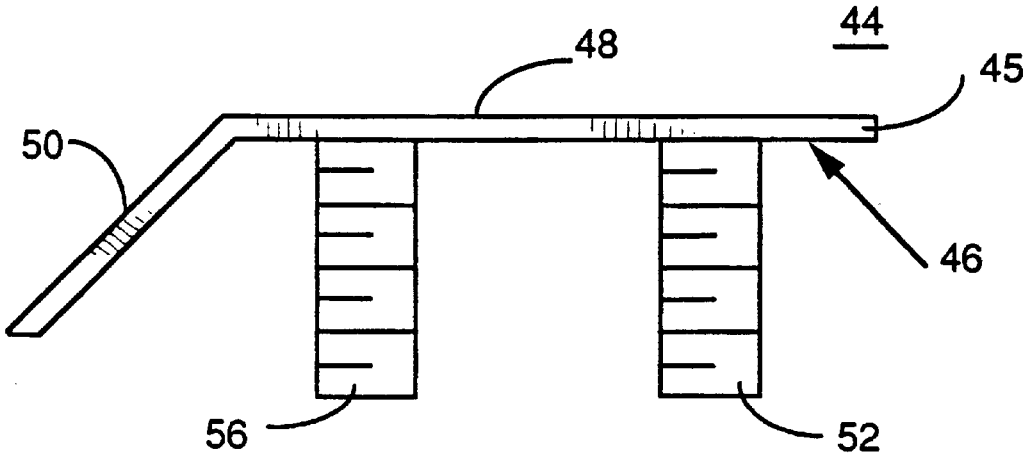
FIG. 3 is a side elevational view of a preferred configuration of a guide plate of the expansion sleeve of FIG. 1.
Figure 4:
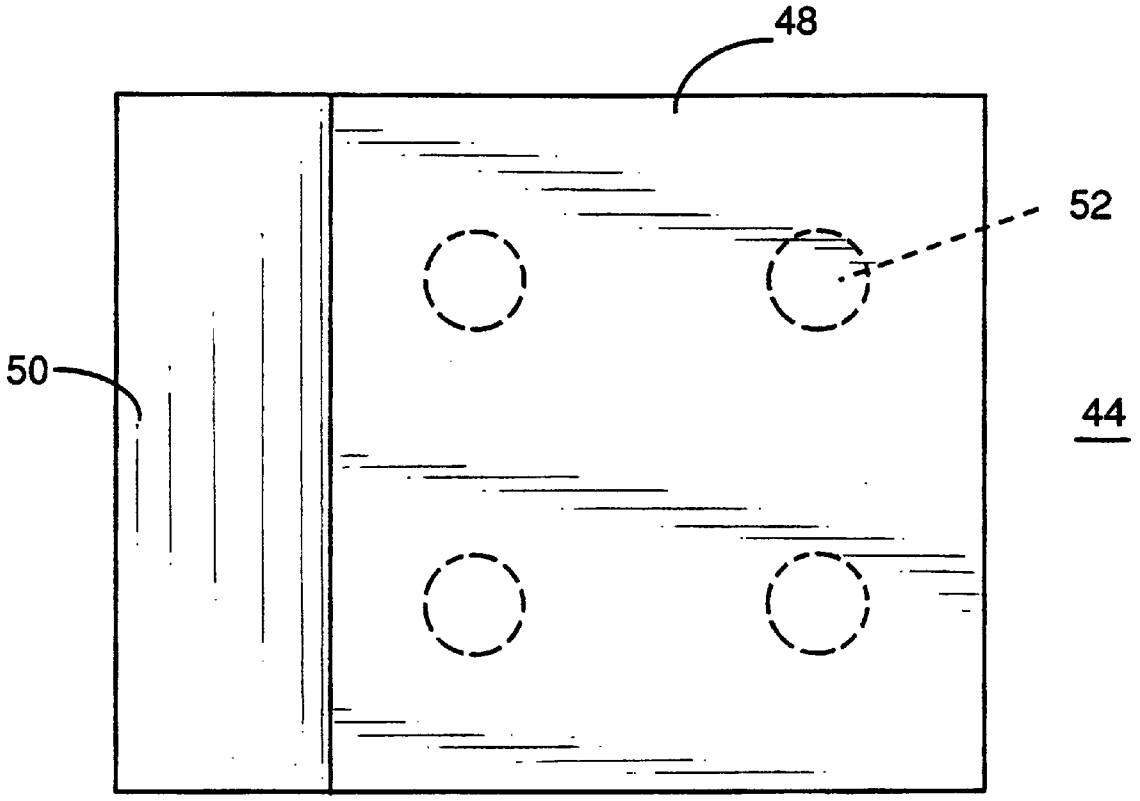
FIG. 4 is a top plan view of the guide plate of FIG. 3.

The preferred design of guide plates 44 is shown in FIGS. 3 and 4. Each guide plate 44 is constructed of a steel plate 45 that will withstand bumps and abrasions by the coils and will protect the sleeve member 12. Each guide plate 44 includes a first region 48 and a second region 50 at an angle selected to match the angle of the chamfered region 40 of an end (15, 17). Therefore, in the preferred embodiment the second region 50 is angled at 45° to the first region 48 to conform to the 45° angle of the chamfered region 40. The length of each guide plate 44 is selected to provide sufficient protection to the corresponding end (15, 17) and, preferably, covers six inches of the sleeve member 12 as measured along the sleeve member's longitudinal axis. Each guide plate must be secured to the sleeve member 12 and is preferably secured by four threaded studs 52 disposed on the surface of first region 48 opposite the surface of the first region 48 that is to be exposed. The studs 52 pass through bores 56 in the sleeve member 12 and are secured by correspondingly threaded nuts (not shown). To protect the payoff reel 24 from abrasion by the threaded studs 52, the studs 52 may be countersunk below the inner surface 18 of the sleeve member 12.

Although the coil guides of the present invention have been described herein in the form of guide plates 44, it will be understood that numerous alternate coil guide designs that protect to one or both ends (15, 17) from contact with the coil will be apparent to those having ordinary skill in the relevant art. It is intended that each such obvious alternate design is encompassed within the scope of the present invention.

Figure 5:
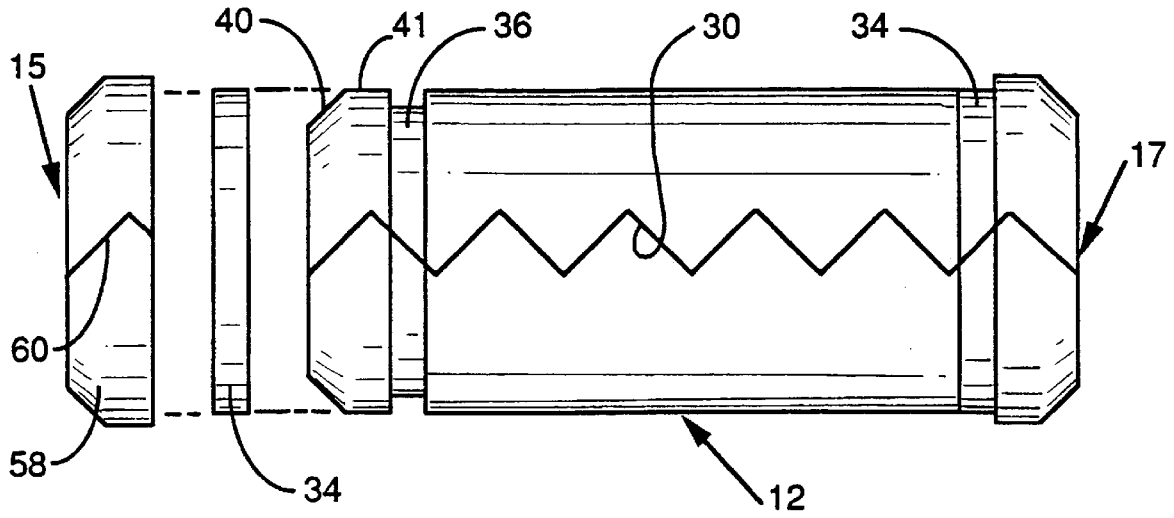
FIG. 5 is an assembly view in perspective of the expansion sleeve of FIG. 1 wherein a cowling is substituted for individual guide plates.

One alternate design of the coil guide of the present invention is a cowling 58 of a durable material as shown in FIG. 5. As is the case with each guide plate 44, cowling 58 includes a surface configured to conform to at least a portion of the chamfered region 40 and the adjacent non-chamfered region 41 of at least one end (15, 17) of the sleeve member 12. However, the cowling 58 will cover the entire perimeter of a portion of the end (15, 17) on which it is disposed. The cowling 58 may be attached by any known means, for example, by a bolt and nut arrangement as used to attach each of the guide plates 44, and must include a cowling slit 60 entirely through the cowling 58 to allow the cowling 58 to expand as the sleeve member 12 expands.

Although the foregoing embodiment has been described for use on an expansible payoff reel used to securely hold a coil during payoff, it will be understood that the present expansion sleeve may be used with like effect on any expansible reel member wherein it is desired to increase the effective outer diameter of the reel. It will also be understood that various changes in the details, materials, arrangement of parts which have been herein described and illustrated in order to explain the nature of the invention may be made by those skilled in the art and that those changes are within the principle and scope of the invention as expressed in the appended claims.

What is claimed:

1. An expansion sleeve for increasing a diameter of a payoff reel expansible from a collapsed to an engaged configuration to hold a coil during payoff, the expansion sleeve comprising:

a sleeve member reversibly expansible from a contracted configuration to an expanded configuration, said sleeve member in said contracted configuration comprises a wall defining a hollow, generally cylindrical shape having opposed first and second ends, an external surface defining an outer surface of said sleeve member for contacting the coil and an internal surface defining a void, a slit provided through said wall and continuous between said first and second ends to allow said sleeve member to reversibly expand from said contracted configuration to said expanded configuration;

at least one expansible member for maintaining said expansion sleeve in contact with the payoff reel and allowing said sleeve member to expand as the payoff reel expands from the collapsed to the engaged configuration; and a coil guide comprised of a durable material, said coil guide disposed on said sleeve member to protect said sleeve member from damage when the coil is introduced onto the expansion sleeve.

2. The expansion sleeve recited in claim 1 wherein said slit is generally along a longitudinal axis of said sleeve member and is of an overlapping sawtooth design to inhibit the coil from grabbing said sleeve member during payoff.

3. The expansion sleeve recited in claim 1 wherein said at least one expansible member is a continuous band comprising elastic material having a thickness and being disposed around said outer surface of said sleeve member and across said slit.

4. The expansion sleeve recited in claim 3 wherein said outer surface of said wall includes at least one groove therein having a depth, said band disposed in said groove.

5. The expansion sleeve recited in claim 4 comprising two said bands and two said grooves, one said groove adjacent each said first and second end of said wall.

6. The expansion sleeve recited in claim 4 wherein said depth of said groove is greater than said thickness of said band so that said band is countersunk in said groove.

7. The expansion sleeve recited in claim 1 wherein a mating surface of said coil guide is configured to conform to and is disposed on at least a portion of said outer surface of said at least one said first and second ends of said wall.

8. The expansion sleeve recited in claim 7 wherein said outer surface of said at least one said first and second ends of said wall comprises a terminal chamfered region and an adjacent non-chamfered region to define a guide region, and wherein said mating surface of said coil guide is configured to conform to and is disposed on at least a portion of said guide region.

9. The expansion sleeve recited in claim 8 wherein said coil guide comprises a plurality of guide plates, each said guide plate comprising a mating surface configured to conform to a portion of said guide region, said guide plates being disposed at intervals about said guide region.

10. The expansion sleeve recited in claim 8 wherein said coil guide is a cowling defining a substantially circular bore, said mating surface of said cowling being disposed on said guide region so that said circular bore allows the payoff reel access to said void of said sleeve member, said cowling having a gap therein to allow said cowling to expand with said sleeve member.

11. The expansion sleeve recited in claim 10 herein said gap is of an overlapping sawtooth design to inhibit the coil from grabbing said cowling during payoff.

12. An expansion sleeve for increasing a diameter of a payoff reel expansible from a collapsed to an engaged configuration to hold a coil during payoff, the expansion sleeve comprising:

a sleeve member reversibly expansible from a contracted configuration to an expanded configuration and comprising a generally cylindrical wall comprising opposed first and second ends, an external surface defining a curved outer surface of said sleeve member of at least about 90 durometer hardness for contacting the coil and an internal surface defining a void to allow said sleeve member in said contracted configuration to be disposed about the collapsed payoff reel, each said first and second end of said wall comprising a terminal chamfered region and an adjacent non-chamfered region to define guide regions, a slit being provided in said wall continuous between said first and second ends to allow said sleeve member to reversibly expand and being disposed generally along a longitudinal axis of said sleeve member and of an overlapping sawtooth design to inhibit the coil from grabbing said sleeve member during payoff, two grooves having a depth being disposed about said curved outer surface of said sleeve member, one said groove adjacent each said guide regions;

two expansible members for maintaining said expansion sleeve in contact with the payoff reel and allowing said sleeve member to expand as the payoff reel expands, each said expansible member comprising a band of elastic rubber material of about 70 durometer hardness and having a thickness less than said depth of said grooves, each said band being disposed in one of said grooves; and a coil guide of a durable material disposed on said sleeve member to protect said sleeve member from damage when the coil is introduced onto the expansion sleeve, said coil guide comprising a plurality of guide plates, each said guide plate having a mating surface configured to conform to said guide region, said guide plates disposed at intervals about each said guide region.

* * * * *